US008469352B2

(12) United States Patent
Kunioka

(10) Patent No.: US 8,469,352 B2
(45) Date of Patent: Jun. 25, 2013

(54) IMAGE FORMING APPARATUS WITH ROTATABLE SHEET FEED UNIT

(75) Inventor: Satoshi Kunioka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/479,380

(22) Filed: May 24, 2012

(65) Prior Publication Data

US 2012/0313310 A1 Dec. 13, 2012

(30) Foreign Application Priority Data

Jun. 7, 2011 (JP) ..... 2011-127138

(51) Int. Cl.
*B65H 1/00* (2006.01)

(52) U.S. Cl.
USPC ..... 271/3.14; 271/164; 271/171; 271/213

(58) Field of Classification Search
USPC ..... 271/3.14, 145, 162, 164, 171, 207, 271/213; 399/393
See application file for complete search history.

(56) References Cited

U.S. PATENT DOCUMENTS

| | | | | |
|---|---|---|---|---|
| 5,593,152 | A * | 1/1997 | Wirth et al. | 271/241 |
| 7,469,981 | B2 | 12/2008 | Katsuyama et al. | |
| 7,862,037 | B2 | 1/2011 | Kunioka | |
| 7,931,267 | B2 * | 4/2011 | Kajiyama | 271/164 |
| 8,172,222 | B2 * | 5/2012 | Yoda et al. | 271/162 |
| 8,210,524 | B2 * | 7/2012 | Uchida | 271/164 |

FOREIGN PATENT DOCUMENTS

| | | | |
|---|---|---|---|
| JP | 05000735 | A * | 1/1993 |
| JP | 2000-226150 | | 8/2000 |

* cited by examiner

*Primary Examiner* — Jeremy R Severson
(74) *Attorney, Agent, or Firm* — Cooper & Dunham LLP

(57) ABSTRACT

An image forming apparatus includes a body, a sheet feed unit, a regulator, an image forming device, and a sheet output unit. The sheet feed unit is removably mounted to the body to store a recording medium. The regulator has a locking portion and is disposed in the sheet feed unit to regulate a position of the medium in a width direction of the medium. The image forming device forms an image on the medium conveyed from the sheet feed unit. The sheet output unit is disposed above the sheet feed unit to stack the medium on which the image is formed by the image forming device. When the sheet feed unit is drawn from the body to a predetermined position, the sheet feed unit is rotatable downward by weight of the sheet feed unit and the sheet output unit rotates upward with rotation of the sheet feed unit.

16 Claims, 6 Drawing Sheets

IMAGE FORMING APPARATUS WITH ROTATABLE SHEET FEED UNIT

CROSS-REFERENCE TO RELATED APPLICATION

This patent application is based on and claims priority pursuant to 35 U.S.C. §119 to Japanese Patent Application No. 2011-127138, filed on Jun. 7, 2011 in the Japan Patent Office, the entire disclosure of which is hereby incorporated by reference herein.

BACKGROUND

1. Technical Field

This disclosure relates to an image forming apparatus.

2. Description of the Related Art

Image forming apparatuses are widely used as printers, facsimile machines, copiers, plotters, or multi-functional devices having two or more of the foregoing capabilities. Much image forming apparatuses are capable of copying with different magnifications. To copy with different magnifications, such image forming apparatuses mount a sheet feed tray (cassette) to store different sizes of recording media and selectively feed a designated type of recording media.

As one type of the sheet feed tray, for example, a front loading system may be employed in favor of an advantage that recording media can be easily loaded to the sheet feed tray and there is no need for large spaces at both sides of the image forming apparatus. For the front loading system, a user draws the sheet feed tray from a body of the image forming apparatus, loads recording media to the sheet feed tray, and pushes the sheet feed tray from the front side to the rear side of the image forming apparatus. As a result, the sheet feed tray is mounted at a predetermined position in the image forming apparatus, and recording media are fed from the sheet feed tray. To load different sizes of recording media to the sheet feed tray, a side fence with a lock may be provided in the sheet feed tray to regulate and fix the position of recording media in the width direction.

In such a case, even if a user does not see the lock of the side fence in the sheet feed tray and does not sufficiently draw the sheet feed tray to a position at which the lock can be released, recording media can be loaded to the sheet feed tray. As a result, without noticing that the side fence is locked or seeing the lock of the side fence, the user may not be able to set recording media properly, or may have difficulties or not be able to move or fix the side fence at a proper position.

To do with the above-described problem, for example, JP-2000-226150-A proposes an image forming apparatus in which a sheet output tray is opened with movement of the sheet feed tray. However, the image forming apparatus is disadvantageous in that, when the sheet feed tray is drawn, friction resistance between the sheet feed tray and the sheet output tray increases, thus reducing the operability of the sheet feed tray.

BRIEF SUMMARY

In an aspect of this disclosure, there is provided an image forming apparatus including a body, a sheet feed unit, a regulator, an image forming device, and a sheet output unit. The sheet feed unit is removably mounted to the body to store a recording medium. The regulator has a locking portion and is disposed in the sheet feed unit to regulate a position of the recording medium in a width direction of the recording medium. The image forming device forms an image on the recording medium conveyed from the sheet feed unit. The sheet output unit is disposed above the sheet feed unit to stack the recording medium on which the image is formed by the image forming device. When the sheet feed unit is drawn from the body to a predetermined position, the sheet feed unit is rotatable downward by weight of the sheet feed unit and the sheet output unit rotates upward with rotation of the sheet feed unit.

In another aspect of this disclosure, there is provided an image forming apparatus including a body, a sheet feed unit, a regulator, and an upper cover. The sheet feed unit is removably mounted to the body to store a recording medium. The regulator has a locking portion and is disposed in the sheet feed unit to regulate a position of the recording medium in a width direction of the recording medium. The upper cover is rotatably fixed to the body to cover an area above the sheet feed unit. When the sheet feed unit is drawn from the body to a predetermined position, the sheet feed unit is rotatable downward by weight of the sheet feed unit and the upper cover rotates upward with rotation of the sheet feed unit.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
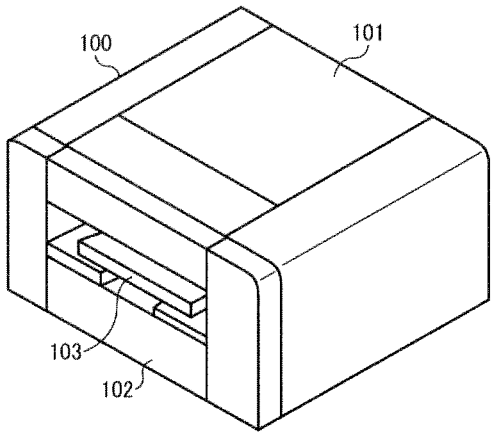
FIG. 1 is an external perspective view of an image forming apparatus according to an exemplary embodiment of the present disclosure.

The accompanying drawings are intended to depict exemplary embodiments of the present disclosure and should not be interpreted to limit the scope thereof The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Figure 2:
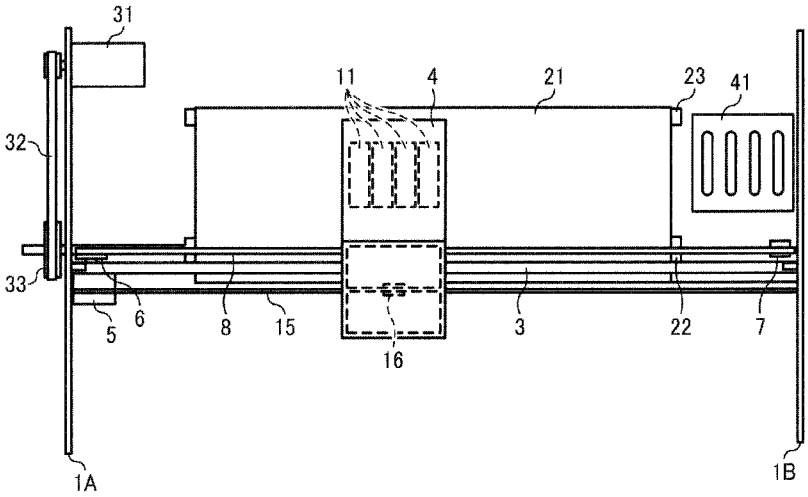
FIG. 2 is a partial plan view of a mechanical section of the image forming apparatus illustrated in FIG. 1.

First, an image forming apparatus according to an exemplary embodiment of the present disclosure is described with reference to FIGS. 1 and 2. FIG. 1 is an external perspective view of the image forming apparatus. FIG. 2 is a plan view of a mechanical section of the image forming apparatus.

The image forming apparatus illustrated in FIGS. 1 and 2 is a serial-type inkjet recording apparatus and has an openable cover 101 at an upper face side of a body 100. By opening the cover 101, an operator can access the mechanical section inside the body 100.

As illustrated in FIG. 2, the mechanical section includes a main left-side plate 1A, a main right-side plate 1B, a guide member 3, a carriage 4, a main scanning motor 5, a driving pulley 6, a driven pulley 7, and a timing belt 8. The guide member 3 extends between the main side plates 1A and 1B to support the carriage 4. The carriage 4 is supported on the guide member 3 so as to be slidable in a main scanning direction. The carriage 4 is moved for scanning in the main scanning direction by the main scanning motor 5 via the timing belt 8 extending between the driving pulley 6 and the driven pulley 7.

The carriage 4 mounts recording head units 11 and head tanks. The recording head units 11 (hereinafter also simply referred to as "recording heads 11") are liquid ejection heads serving as image forming devices to eject ink droplets of different colors, for example, yellow (Y), cyan (C), magenta (M), and black (K). The head tanks supply ink to the recording heads. The recording heads 11 are mounted on the carriage 4 so that multiple nozzle rows each including a plurality of nozzles are arranged parallel to a sub scanning direction perpendicular to the main scanning direction and ink droplets are ejected downward from the nozzles. The recording heads 11 and a head holder holding the recording heads 11 are integrally mounted on the carriage 4 as a single unit.

An encoder scale 4 is disposed along the main scanning direction of the carriage 4. On the carriage 4 is mounted an encoder sensor 16 serving as a transmissive photosensor to read a scale (scale index serving as position identifier) of the encoder scale 15. The encoder scale 15 and the encoder sensor 16 form a linear encoder serving as a position detector to detect the position and speed of the carriage 4.

Below the carriage 4 is disposed a conveyance belt 21 serving as a conveyance unit to convey a recording medium in the sub-scanning direction. The conveyance belt 21 is an endless belt looped around a conveyance roller 22 and a tension roller 23. The conveyance roller 22 is rotated by a sub-scanning motor 31 via a timing belt 32 and a timing pulley 33. The rotation of the conveyance roller 22 causes the conveyance belt 21 to circulate in the sub-scanning direction (indicated by the arrow SSD in FIG. 7).

At one end in the main scanning direction of the carriage 4, a maintenance unit 41 is disposed near one lateral side of the conveyance belt 21 to maintain and recover nozzle conditions of the recording heads 11. The maintenance unit 41 includes, for example, cap members, a wiping member, and a second liquid receptacle. The cap members cap nozzle faces (i.e., faces in which nozzle are formed) of the recording heads 11. The wiping member wipes the nozzle faces of the recording heads. The second liquid receptacle receives droplets ejected by maintenance ejection (flushing) in which liquid droplets not contributing to a resultant image are ejected for, e.g., preventing clogging of nozzles.

As illustrated in FIG. 1, the image forming apparatus further includes a sheet feed tray 102 and a sheet output tray 103 removably mounted to the body 102. The sheet feed tray 102 serves as a sheet feed unit to store and feed sheets to the conveyance belt 21. The sheet output tray 103 serves as a sheet output unit to output a recording medium on which ink droplets ejected from the recording heads 11 have adhered to form an image. It is to be noted that the term "sheet" used herein is not limited to a sheet of paper but be, e.g., an OHP (overhead projector) sheet or anything on which droplets of ink or other liquid can be adhered. In other words, the term "sheet" is used as a generic term including a recording medium, a recorded medium, a recording sheet, or a recording sheet of paper.

The sheet output tray 103 is disposed above the sheet feed tray 102 and is rotatable around a shaft 120 (see FIG. 6) disposed at its rear side. In other words, the sheet output tray 103 also serves as an upper cover to cover an area above the sheet feed tray 102. The sheet output tray 103 has an extending portion 114 (see FIG. 3) extendable to store a relatively large size of recording media.

While moving the carriage 4 in the main scanning direction, the image forming apparatus drives the recording heads 11 in accordance with image signals to eject ink droplets onto a recording medium conveyed intermittently by the conveyance belt 21. After a first band of an image is recorded on the recording medium, the recording medium is conveyed at a certain distance by the conveyance belt 21. Then, another band of the image is recorded on the recording medium and the recording medium is conveyed at the certain distance. Such operation is repeated to form the full image and then the recording medium having the image is output to the sheet output tray 103.

Figure 3:
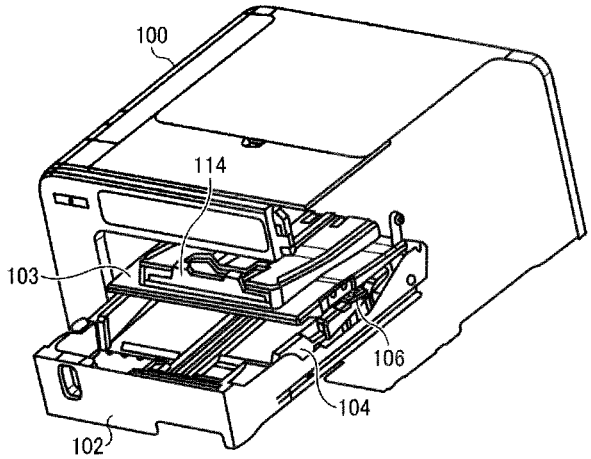
FIG. 3 is a partial perspective view of the image forming apparatus in a state in which a sheet feed tray is slightly drawn from a body.
Figure 4:
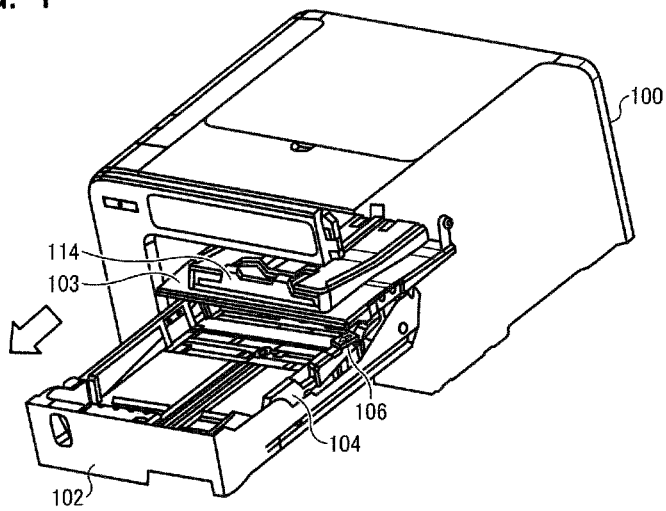
FIG. 4 is a partial perspective view of the image forming apparatus in a state in which a sheet feed tray is drawn to a predetermined position.
Figure 5:
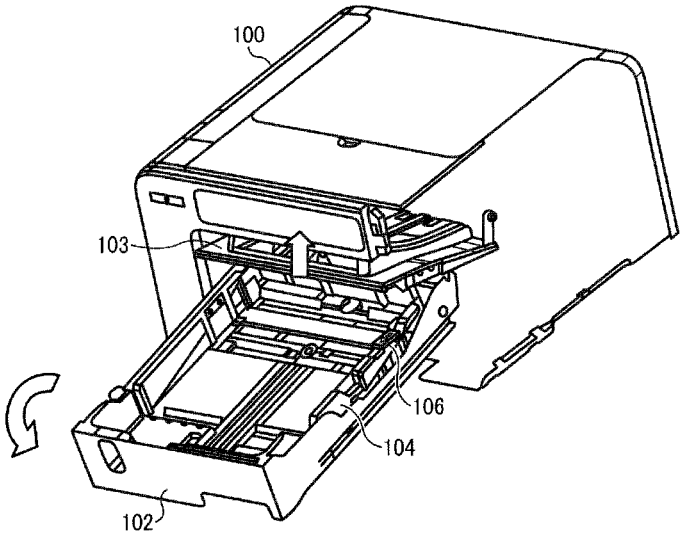
FIG. 5 is a partial perspective view of the image forming apparatus in a state in which, at the predetermined position, the sheet feed tray moves down by its weight and, as a result, a sheet output tray is pushed up.

FIGS. 3 to 5 show an image forming apparatus according to an exemplary embodiment.

Figure 6:
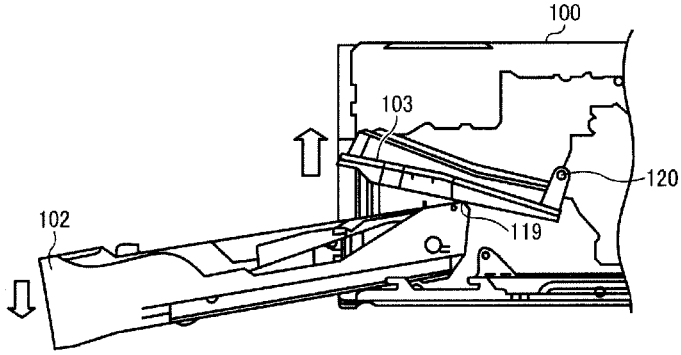
FIG. 6 is a side view of the image forming apparatus illustrated in FIG. 5.

FIG. 3 is a partial perspective view of the image forming apparatus at a state in which a sheet feed tray 102 is slightly drawn from a body 100. FIG. 4 is a partial perspective view of the image forming apparatus at a state in which the sheet feed tray 102 is drawn from the body 100 to a predetermined position. FIG. 5 is a partial perspective view of the image forming apparatus at a state in which the sheet output tray 103 is pushed up by the sheet feed tray 102 sinking down by its weight at the predetermined position. FIG. 6 is a side view of the image forming apparatus illustrated in FIG. 5.

As illustrated in FIG. 4, when a user horizontally draws the sheet feed tray 102 to the predetermined position, a projecting portion 105 (see FIG. 7) disposed at a central rear side of a back face of the sheet feed tray 102 engages a protruding portion 107 (see FIG. 7) disposed at a central front side of a bottom face of the body 100 to determine the predetermined position. Thus, the sheet feed tray 102 stops at the predetermined position. When the sheet feed tray 102 is placed at the predetermined position, no force is applied to the sheet output tray 103 and the sheet output tray 103 is stationary.

In addition, when the sheet feed tray 102 is placed at the predetermined position, a user can easily see a side fence lock 106 serving as a locking portion of a side fence 104. The side fence 104 serves as a regulator to regulate the position of recording media in the sheet feed tray 102. For example, when the side fence lock 106 is released by moving to the front side, the side fence 104 can be moved in a width direction of recording media to take a position in accordance with the size of recording media. It is to be noted that the structures of the side fence 104 and the side fence lock 106 may be any suitable structures, and detailed descriptions thereof are omitted here.

Figure 7:
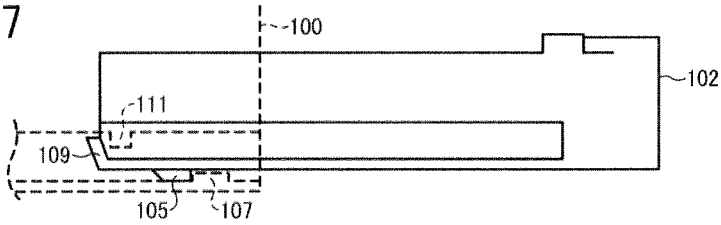
FIG. 7 is a schematic partial side view of the image forming apparatus in a state in which, when the sheet feed tray is placed at the predetermined position of FIG. 4, a projecting portion disposed at a central rear side of a back face of the sheet feed tray engages a protruding portion disposed at a central front side of a bottom face of the body.

FIG. 7 is a schematic partial side view of the image forming apparatus in a state in which, when the sheet feed tray 102 is placed at the predetermined position of FIG. 4, the projecting portion 105 disposed at the central rear side of the back face of the sheet feed tray 102 engages the protruding portion 107 disposed at the central front side of the bottom face of the body 100.

In FIG. 7, the sheet feed tray 102 is drawn from the left side to the right side. In addition, as illustrated in FIG. 7, an engagement portion 109 is provided at a rear side of each outer (lateral) side face of the sheet feed tray 102, i.e., each side face in a width direction perpendicular to a direction in which the sheet feed tray 102 is drawn from the body 100. A restricting portion 111 is provided at a front side of each inner (lateral) side face of the body 100 so as to correspond to the engagement portion 109.

Figure 8:
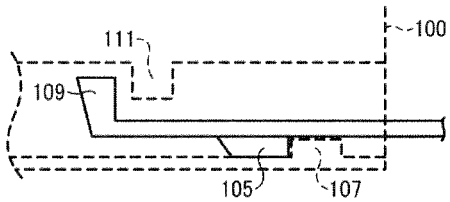
FIG. 8 is a partially enlarged side view of the image forming apparatus of FIG. 7.

FIG. 8 is a partially enlarged side view of the image forming apparatus of FIG. 7.

As illustrated in FIG. 8, the projecting portion 105 projects downward from the back face of the sheet feed tray 102, and the protruding portion 107 protrudes upward from the bottom face of the body 100. As a result, when the sheet feed tray 102 is drawn straight from the body 100, the projecting portion 105 engages the protruding portion 107 and the sheet feed tray 102 stops at the predetermined position illustrated in FIG. 8. In such a case, the protruding portion 107 is preferably disposed adjacent to the front face of the body at the right side of FIG. 8 (e.g., at a front end portion of the front face of the body) so that the sheet feed tray 102 is sufficiently drawn from the body 100 to allow a user to easily load even a small size of recording media into the sheet feed tray 102.

At this time, since there is a clearance between the engagement portion 109 at each outer side face of the sheet feed tray 102 and the restricting portion 111 at each inner side face of the body 100, the sheet feed tray 102 can move up and down at a distance corresponding to the clearance while the protruding portion 107 prevents the sheet feed tray 102 from further moving in the drawing direction. In other words, the sheet feed tray 102 can rotate clockwise in FIG. 8 relative to the body 100 at the distance corresponding to the clearance. At the predetermined position, the center of gravity of the sheet feed tray 102 is positioned at the front side of the body 100 close to a user standing on the right side of FIG. 8.

As illustrated in FIGS. 5 and 6, when the user releases his/her hand from the sheet feed tray 102 at the predetermined position, the front end of the sheet feed tray 102 rotates downward (drops) by its weight. With the rotation, lateral end portions of the bottom face of the sheet output tray 103 are pressed upward by upper rear-end portions 119 of lateral sides of the sheet feed tray 102, so that the sheet output tray 103 rotates upward (is pushed up) around a rotation shaft 120. As described above, when the sheet feed tray 102 rotates by its weight, the sheet output tray 103 receives an effort from the sheet feed tray 102. Such a configuration allows the sheet output tray 103 to rotate upward by a force with which the sheet feed tray 102 moves downward by its weight, thus obviating a special operation of the user for rotating the sheet feed tray 102.

At this time, since the sheet feed tray 102 rotates downward and the sheet output tray 103 rotates upward, the clearance between the sheet feed tray 102 and the sheet output tray 103 increases. As a result, the user can easily see the side fence lock 106 of the sheet feed tray 102 from the increased clearance and handle the side fence lock 106 in accordance with the size of recording media, thus allowing reliable and prompt loading of recording media.

As described above, when the sheet feed tray 102 is inserted to the body 100 or drawn from the sheet feed tray 102, the sheet output tray 103 does not move along with the sheet feed tray 102. Such a configuration prevents an extra load from being applied to the sheet feed tray 102, thus obtaining good operability of the sheet feed tray 102.

Figure 9:
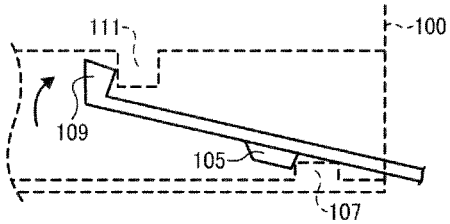
FIG. 9 is a schematic side view of the image forming apparatus in a state in which an engagement portion at each outer side face of the sheet feed tray engages a restricting portion at each inner side face of the body and (downward) rotation of the sheet feed tray is restricted.

FIG. 9 corresponds to FIG. 5 and is a schematic side view of the image forming apparatus in a state in which the engagement portion 109 at each outer side face of the sheet feed tray 102 engages the restricting portion 111 at each inner side face of the body 100 and (downward) rotation of the sheet feed tray 102 is restricted.

As described above, since there is a clearance between the engagement portion 109 and the restricting portion 111, the sheet feed tray 102 can rotate relative to the body 100 at a distance corresponding to the clearance. However, when the sheet feed tray 102 further rotates with the projecting portion 105 engaging the protruding portion 107, the engagement portion 109 engages the restricting portion 111. As a result, the sheet feed tray 102 is restricted so as not to further rotate and locked at the position.

Accordingly, when the user draws the sheet feed tray 102 to the predetermined position illustrated in FIGS. 4, 7, and 8 and releases his/her hand, the sheet feed tray 102 automatically rotates downward by its weight to the position illustrated in FIGS. 5 and 9. However, even if the user continues to release his/her hand, the engagement of the engagement portion 109 and the restricting portion 111 and the engagement of the projecting portion 105 and the protruding portion 107 prevent the sheet feed tray 102 from further rotating or dropping down.

Figure 10:
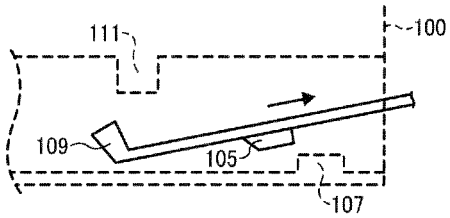
FIG. 10 is a schematic side view of the image forming apparatus in a state in which the sheet feed tray is being removed from the body.

When the front end of the sheet feed tray 102 (at the right side of FIG. 8) is lifted up from the state illustrated in FIG. 8, as illustrated in FIG. 10, an upper end of the engagement portion 109 is placed at a position lower than a lower end of the restricting portion 111. In addition, a lower end of the projecting portion 105 is placed at a position higher than an upper face of the protruding portion 107. Thus, as illustrated in FIG. 10, by temporarily lifting the front end of the sheet feed tray 102 upward and then drawing the sheet feed tray 102, the user can remove the sheet feed tray 102 from the body 100. In addition, by performing the opposite procedure, the user can insert the sheet feed tray 102 to the body 100.

Figure 11:
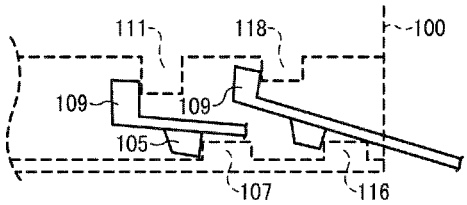
FIG. 11 is a schematic side view of another configuration of the image forming apparatus having protruding portions and restricting portions to allow stepwise rotation of the sheet feed tray.

FIG. 11 is a schematic side view of another configuration of the protruding portion and the restricting portion to allow stepwise rotation of the sheet feed tray.

In this configuration, besides the protruding portion 107 and the restricting portion 111, a second protruding portion 116 and a second restricting portion 118 are arranged along the direction in which the sheet feed tray 102 is drawn (hereinafter, "drawing direction", i.e., a direction from the left side to the right side of FIG. 11). The second protruding portion 116 is disposed at the bottom face of the body 100 at a position more forward than the protruding portion 107 in the drawing direction of the sheet feed tray 102. The second restricting portion 118 is disposed at each inner side face of the body 100 at a position more forward than the restricting portion 111 in the drawing direction of the sheet feed tray 102. A lower end of the second restricting portion 118 is disposed at a position higher than a lower end of the restricting portion 111.

When the sheet feed tray 102 is drawn from the body 100, the projecting portion 105 contacts the protruding portion 107. When the sheet feed tray 102 rotates by its weight, the engagement portion 109 is restricted by the restricting portion 111. Thus, as illustrated in FIG. 11, a first-step rotational position is determined. When the sheet feed tray 102 is further drawn, the projecting portion 105 contacts the second protruding portion 116. At this position, the sheet feed tray 102 can rotate by its weight at a greater angle to a position at which the engagement portion 109 is restricted by the second restricting portion 118 positioned higher than the engagement portion 109. Thus, as illustrated in FIG. 11, a second-step rotational position is determined.

In such a configuration, the sheet feed tray 102 is rotated at a greater angle to the second-step rotational position and a greater clearance is formed between the sheet feed tray 102 and the sheet output tray 103. As described above, since the sheet feed tray 102 can rotate at a greater angle to the second-step rotational position, the user can select the first-step rotational position or the second-step rotational position according to the needs.

In such a case, preferably, the second protruding portion 116 is disposed adjacent to the front face of the body 100 and the protruding portion 107 is disposed adjacent to the second protruding portion 116 so that the sheet feed tray 102 is sufficiently drawn from the body 100 so as to allow a user to easily load even a small size of recording media into the sheet feed tray 102.

When the sheet feed tray 102 is drawn to the second-step rotational position, as described above, the user can temporarily lift the front end of sheet feed tray upward relative to the body 100 and then draw the sheet feed tray 102 so that the engagement portion 109 does not engage the restricting portion 111 and the projecting portion 105 does not engage the protruding portion 107. In addition, by performing the opposite procedure, the user can insert the sheet feed tray 102 to the body 100.

Another exemplary embodiment of this disclosure to allow stepwise rotation of the sheet feed tray is described with reference to FIGS. 12 to 14.

In this exemplary embodiment, unlike the exemplary embodiment illustrated in FIG. 11, the second protruding portion 116 and the second restricting portion 118 are not provided. However, the other configurations of the protruding portion 107, the restricting portion 111, and so on are substantially the same as the exemplary embodiment illustrated in FIGS. 7 to 10.

In this exemplary embodiment, when a small size of recording media (e.g., A6-size media) are loaded to a sheet feed tray 102, the clearance between the sheet feed tray 102 and a sheet output tray 103 can be easily extended. Typically, when recording media are loaded to the sheet feed tray, the recording media need to contact a rear end of the sheet feed tray to be fed from the sheet feed tray. Therefore, when a small size of recording media is loaded to the sheet feed tray 102, preferably, a greater clearance to facilitate loading of recording media is formed between the sheet feed tray 102 and the sheet output tray 103 than when a large size of recording media (e.g., A4-size media) is loaded.

Figure 12:
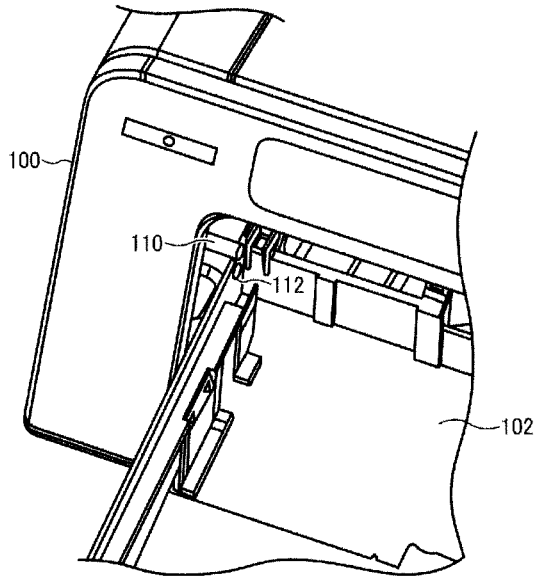
FIG. 12 is a schematic partial view of an image forming apparatus according to another exemplary embodiment of this disclosure having a damper lock at a body and a lock receiving portion at a sheet feed tray to allow stepwise rotation of the sheet feed tray.
Figure 13:
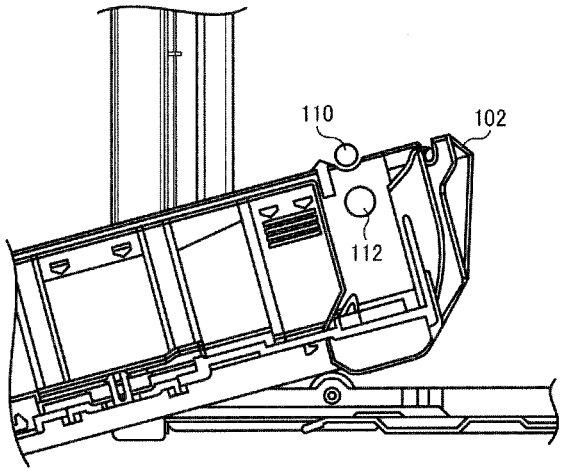
FIG. 13 is a partial side view of the image forming apparatus of FIG. 12 in a state in which the sheet feed tray is placed at a first-step rotational position.

Hence, as illustrated in FIGS. 12 and 13, a damper lock 110 is disposed at a body 100, and a lock receiving portion 112 is disposed at a side face of the sheet feed tray 102. The damper lock 110 has a pin fixed at the body 100 and a spring mounted on the pin. The damper lock 110 protrudes from each side of the interior of the body 100 toward the interior of the sheet feed tray 102 by an urging force of the spring and extends to an upper portion of the side face of the sheet feed tray 102. When a force against the urging force of the spring is applied, the damper lock 110 retracts.

FIG. 13 shows a first-step rotational position of the sheet feed tray 102 determined by a projecting portion 105, a protruding portion 107, an engagement portion 109, and a restricting portion 111. When the sheet feed tray 102 is placed at the first-step rotational position, the damper lock 110 is placed at a recess of the upper portion of the side face of the sheet feed tray 102, and applies a downward force to the sheet feed tray 102 to determine the first-step rotational position.

The lock receiving portion 112 of a hole shape corresponding to the damper lock 110 is disposed at a rear end portion of the side face of the sheet feed tray 102 and at a position lower than the damper lock 110. As a result, when a user loads a small size of recording media, by pushing the front end of the sheet feed tray 102 further downward from the first-step rotational position illustrated in FIG. 13, the rear end portion of the side face of the sheet feed tray 102 pushes the damper lock 110 up against the urging force of the spring.

Figure 14:
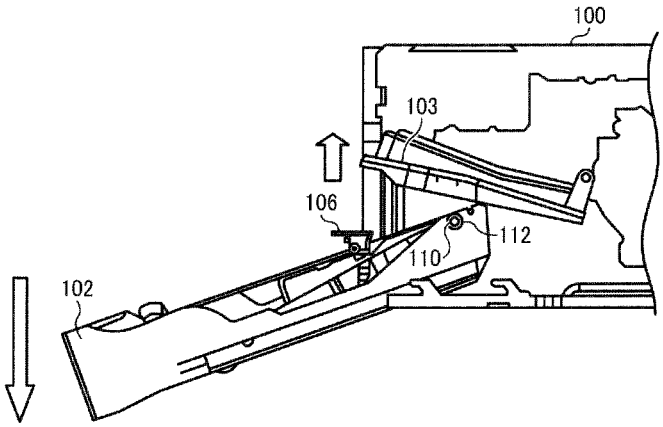
FIG. 14 is a partial side view of the image forming apparatus of FIG. 12 in a state in which the sheet feed tray is placed at a second-step rotational position.

As a result, as illustrated in FIG. 14, when the damper lock 110 temporarily retracts and slides on an outer side of the side face of the sheet feed tray 102 and the lock receiving portion 112 is pushed up to a position of the damper lock 110, the damper lock 110 protrudes again toward the interior of the sheet feed tray 102 by the urging force of the spring and engages the lock receiving portion 112. Thus, the second-step rotational position of the sheet feed tray 102 is determined To release the locked state, the front end of the sheet feed tray is lifted up against the urging force of the spring of the damper lock 110 engaging the lock receiving portion 112. Thus, without using a great force, the lock receiving portion 112 at the rear end portion of the side face of the sheet feed tray 102 is released from the damper lock 110. Then, the sheet feed tray 102 is returned to the position illustrated in FIG. 13 corresponding to the first-step rotational position of the sheet feed tray 102 illustrated in FIGS. 5, 6, and 9.

The urging force of the spring is adjustable so that, when the sheet feed tray 102 containing or not containing recording media rotates downward by its weight and takes the first-step rotational position of FIG. 13, the sheet feed tray 102 does not automatically rotate by its weight to the second-step rotational position.

As illustrated in FIG. 14, at the second-step rotational position, the rotation angle of the sheet feed tray 102 is greater than the rotation angle at the first-step rotational position illustrated in FIG. 6. As a result, a greater clearance is formed between the sheet feed tray 102 and the sheet output tray 103. Thus, even in loading a small size of recording media, the user can see the side fence lock 106 of the side fence 104 in the sheet feed tray 102 and, if needed, release the locked state and handle the side fence 104. Thus, the user can easily bring recording media into contact with the rear end of the sheet feed tray 102.

In this exemplary embodiment, the first-step rotational position of the sheet feed tray 102 rotated by its weight is determined by the projecting portion 105, the protruding portion 107, the engagement portion 109, and the restricting portion 111. The second-step rotational position of the sheet feed tray 102 pushed further downward by a user is determined by the damper lock 110 and the lock receiving portion 112. In this case, the first-step rotational position of the sheet feed tray 102 is determined by the engagement of the projecting portion 105 and the protruding portion 107 illustrated in FIG. 9 and/or the contact of the upper portion of the side face of the sheet feed tray 102 and the damper lock 110 illustrated in FIG. 13. At this time, there still remains a clearance between the engagement portion 109 and the restricting portion 111 so that the engagement portion 109 can further rotate clockwise in FIG. 9. Such a configuration allows a user to further push down the sheet feed tray 102 so as to rotate the sheet feed tray 102 to the second-step rotational position. Thus, the second-step rotational position can be determined by the engagement of the damper lock 110 and the lock receiving portion 112 and/or the engagement of the engagement portion 109 and the restricting portion 111.

The damper lock 110 and the lock receiving portion 112 in this exemplary embodiment may be provided instead of the engagement portion 109 and the restricting portions 111 and 118 illustrated in FIGS. 7 to 11. In such a case, the urging force of the spring can be adjusted so that, at the predetermined position determined by the engagement of the projecting portion 105 and the protruding portion 107 or 116, the sheet feed tray 102 not containing recording media automatically moves by its weight to the first-step rotational position determined by the engagement of the damper lock 110 and the lock receiving portion 112.

In such a case, a second lock receiving portion may be disposed below the lock receiving portion 112. Such a configuration allows not only the first step rotation of the sheet feed tray 102 defined by the engagement of the damper lock 110 and the lock receiving portion 112 but also the second step rotation of the sheet feed tray 102 defined by the engagement of the damper lock 110 and the second lock receiving portion and caused by a user's further pushing down.

When the sheet feed tray 102 is placed at the first- or second-step rotational position, preferably, the sheet output tray 103 moving with the sheet feed tray 102 takes a maximum rotational position at which the sheet output tray 103 contacts the body 100. At the maximum rotational position, a force of pressing the sheet feed tray 102 downward arises from the sheet output tray 103 contacting the body 100. Such a configuration prevents excessive force from acting on and damaging the projecting portion 105, the protruding portions 107 and 116, the engagement portion 109, the restricting portions 111 and 118, the damper lock 110, and the lock receiving portion 112, or prevents accidental dropping of the sheet feed tray 102.

When a user draws the sheet feed tray 102 to the predetermined position illustrated in FIGS. 4, 7, and 8, the side fence lock 106 of the side fence 104 in the sheet feed tray 102 is placed at a position at which the user can see the side fence lock 106. However, in a case where the sheet output tray 103 is extended to print a relatively large size of recording media, the side fence lock 106 might be difficult for the user to see. Hence, preferably, the extending portion 114 of the sheet output tray is made of a transparent or semi-transparent material (e.g., plastic). Such a configuration allows a user to easily see and handle the side fence 104 and the side fence lock 106 when the sheet output tray 103 is extended.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

For example, the number and position of the above-described projecting portion, protruding portion, engagement portion, restricting portion, damper lock, lock receiving portion and so on may be modified when needed. The image forming apparatus is not limited to the above-described inkjet type but may be, e.g., an electro-photographic type or mimeographic type. The image forming apparatus may be a copier, printer, facsimile machine, or multi-functional device having several of the foregoing capabilities.

What is claimed is:

1. An image forming apparatus comprising:

a body;

a sheet feed unit removably mounted to the body to store a recording medium;

a regulator having a locking portion and disposed in the sheet feed unit to regulate a position of the recording medium in a width direction of the recording medium;

an image forming device to form an image on the recording medium conveyed from the sheet feed unit; and a sheet output unit disposed above the sheet feed unit to stack the recording medium on which the image is formed by the image forming device, wherein, when the sheet feed unit is drawn from the body to a predetermined position, the sheet feed unit is rotatable downward by weight of the sheet feed unit and the sheet output unit rotates upward with rotation of the sheet feed unit.

2. The image forming apparatus of claim 1, further comprising a shaft disposed at the body, the upper cover being rotatable around the shaft, wherein, when the sheet feed unit is drawn from the body and rotates, the sheet feed unit contacts the sheet output unit at a position more forward than the shaft in a direction in which the sheet feed unit is drawn from the body.

3. The image forming apparatus of claim 1, further comprising:

a projecting portion disposed at a back face of the sheet feed unit; and at least one protruding portion disposed at a bottom face of the body so as to correspond to the projecting portion, wherein the projecting portion engages the at least one protruding portion to determine the predetermined position of the sheet feed unit.

4. The image forming apparatus of claim 3, further comprising:

an engagement portion disposed at each of outer side faces of the sheet feed unit; and at least one restricting portion disposed at each of inner side faces of the body so as to correspond to the engagement portion, wherein, when the sheet feed unit rotates, the engagement portion engages the at least one restricting portion.

5. The image forming apparatus of claim 4, wherein, when the projecting portion engages the at least one protruding portion, a clearance is formed between the engagement portion and the at least one restricting portion.

6. The image forming apparatus of claim 4, wherein one of the at least one restricting portion proximal to a front face of the body is disposed at a position higher than another of the at least one restricting portion more distal to the front face of the body than the one of the at least one restricting portion.

7. The image forming apparatus of claim 3, wherein, when the sheet feed unit is drawn straight from the body, the projecting portion engages the at least one protruding portion, and when the sheet feed unit is lifted up relative to the body and drawn from the body, the projecting portion does not engage the at least one protruding portion and the sheet feed unit is removable from the body.

8. The image forming apparatus of claim 1, wherein the sheet feed unit is stepwisely rotatable.

9. The image forming apparatus of claim 1, further comprising:

a lock member disposed at the body to determine a rotational position of the sheet feed unit; and at least one lock receiving portion disposed at a side face of the sheet feed unit to receive the lock member.

10. The image forming apparatus of claim 1, wherein, when the sheet feed unit rotates downward and the sheet output unit rotates upward, the locking portion of the regulator is placed at a position at which a user can see the locking portion.

11. The image forming apparatus of claim 1, wherein the sheet output unit rotates with rotation of the sheet feed unit at the predetermined position and contacts the body.

12. An image forming apparatus comprising:

a body;

a sheet feed unit removably mounted to the body to store a recording medium;

a regulator having a locking portion and disposed in the sheet feed unit to regulate a position of the recording medium in a width direction of the recording medium; and an upper cover rotatably fixed to the body to cover an area above the sheet feed unit, wherein, when the sheet feed unit is drawn from the body to a predetermined position, the sheet feed unit is rotatable downward by weight of the sheet feed unit and the upper cover rotates upward with rotation of the sheet feed unit.

13. The image forming apparatus of claim 12, further comprising a shaft disposed at the body, the upper cover being rotatable around the shaft, wherein, when the sheet feed unit is drawn from the body and rotates, the sheet feed unit contacts the upper cover at a position more forward than the shaft in a direction in which the sheet feed unit is drawn from the body.

14. The image forming apparatus of claim 12, further comprising:

a projecting portion disposed at a back face of the sheet feed unit; and at least one protruding portion disposed at a bottom face of the body so as to correspond to the projecting portion, wherein the projecting portion engages the at least one protruding portion to determine the predetermined position of the sheet feed unit.

15. The image forming apparatus of claim 12, wherein, when the sheet feed unit rotates downward and the upper cover rotates upward, the locking portion of the regulator is placed at a position at which a user can see the locking portion.

16. The image forming apparatus of claim 12, wherein the upper cover rotates with rotation of the sheet feed unit at the predetermined position and contacts the body.

* * * * *